US008490602B2

(12) United States Patent
Powell

(10) Patent No.: US 8,490,602 B2
(45) Date of Patent: Jul. 23, 2013

(54) SEALED WIRE INTERFACE

(75) Inventor: Patrick Powell, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 267 days.

(21) Appl. No.: 13/004,223

(22) Filed: Jan. 11, 2011

(65) Prior Publication Data

US 2011/0168135 A1 Jul. 14, 2011

Related U.S. Application Data

(60) Provisional application No. 61/294,245, filed on Jan. 12, 2010.

(51) Int. Cl.
*F02M 37/04* (2006.01)
*F02M 37/08* (2006.01)

(52) U.S. Cl.
USPC ..... 123/509; 123/143 C

(58) Field of Classification Search
USPC ..... 123/509, 497, 514, 143 C; 439/604, 439/606, 736; 264/255; 417/423.14; 310/85, 310/89, 256
See application file for complete search history.

(56) References Cited

U.S. PATENT DOCUMENTS

| | | | | |
|---|---|---|---|---|
| 2,521,722 | A * | 9/1950 | Hubbell et al. | 439/788 |
| 3,066,277 | A * | 11/1962 | Edmunds | 439/777 |
| 3,397,382 | A * | 8/1968 | Shannon | 439/429 |
| 3,757,283 | A * | 9/1973 | Kelly | 439/726 |
| 6,506,083 | B1 | 1/2003 | Bickford et al. | |
| 6,821,162 | B2 | 11/2004 | Mott et al. | |
| 6,966,800 | B2 | 11/2005 | Mott | |
| 7,025,638 | B2 | 4/2006 | Mott | |
| 7,204,724 | B2 | 4/2007 | Holtz | |
| 7,235,205 | B2 | 6/2007 | Mott et al. | |
| 7,452,247 | B1 | 11/2008 | Rahman et al. | |
| 7,806,109 | B2 * | 10/2010 | Tateishi et al. | 123/509 |
| 2008/0295808 | A1 * | 12/2008 | Tateishi et al. | 123/497 |

* cited by examiner

*Primary Examiner* — Mahmoud Gimie
(74) *Attorney, Agent, or Firm* — Harness, Dickey & Pierce, P.L.C.

(57) ABSTRACT

A fuel pump module flange assembly includes a flange member with an outer surface, an inner surface, and an external boss protruding from the outer surface. The external boss defines an external cavity, and the flange member is monolithic. The assembly also includes an electrically conductive wire that extends through the flange member. The wire has a first portion that protrudes away from the inner surface, and the wire also includes a terminal end that is disposed within the external cavity of the external boss. The wire is monolithic from the terminal end to the first portion.

19 Claims, 6 Drawing Sheets

SEALED WIRE INTERFACE

CROSS-REFERENCE TO RELATED APPLICATION

This application claims the benefit of U.S. Provisional Application No. 61/294,245, filed on Jan. 12, 2010, the entire disclosure of which is incorporated herein by reference.

FIELD

The present disclosure relates to a sealed wire interface, including a stamped sealed wire interface manufactured in part by a molding process.

BACKGROUND

This section provides background information related to the present disclosure which is not necessarily prior art.

Vehicle fuel systems often include a fuel pump module for pumping fuel to the engine. The fuel pump module can be disposed within the fuel tank. Many fuel pump modules have electrical components that need to electrically connect to components that are disposed outside the fuel pump module. Thus, wiring harnesses and/or other connectors are often included on the fuel pump module. Such electrical connectors need to be robust. Also, the electrical connectors need to be readily manufacturable.

SUMMARY

This section provides a general summary of the disclosure, and is not a comprehensive disclosure of its full scope or all of its features.

A fuel pump module flange assembly is disclosed. The assembly includes a flange member with an outer surface, an inner surface, and an external boss protruding from the outer surface. The external boss defines an external cavity, and the flange member is monolithic. The assembly also includes an electrically conductive wire that extends through the flange member. The wire has a first portion that protrudes away from the inner surface, and the wire also includes a terminal end that is disposed within the external cavity of the external boss. The wire is monolithic from the terminal end to the first portion.

A fuel pump module flange assembly is also disclosed that includes a flange member with an outer surface and an inner surface. The flange member is monolithic. The assembly also includes an electrically conductive wire that extends through the flange member from the outer surface to the inner surface. The wire includes an intermediate portion disposed within the flange member between the outer surface and the inner surface. The intermediate portion includes an alignment member that aligns the wire relative to the flange member. The wire is monolithic from outer surface to the inner surface of the flange member.

Moreover, a fuel pump module flange assembly is disclosed that includes a flange member with an outer surface, an inner surface, an external boss protruding from the outer surface, and an internal boss protruding from the inner surface. The external boss defines an external cavity, and the flange member is monolithic. The assembly also includes an electrically conductive wire that is embedded within and extends through the flange member. The wire has a first portion that protrudes away from the inner surface, and the wire also includes a terminal end that is disposed within the external cavity of the external boss. The wire further includes an annular alignment member that is disposed between the first portion and the terminal end. The annular alignment member includes at least one flat surface and includes a through hole that receives a portion of the flange member to couple the flange member and the wire. The wire is monolithic from the terminal end to the first portion, and the flange member is overmolded around the electrically conductive wire.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
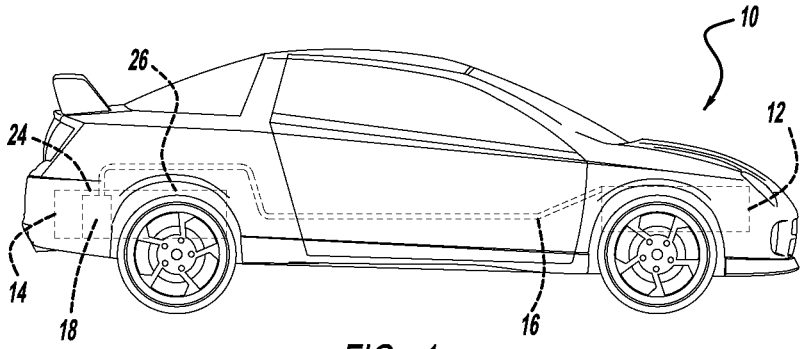
FIG. 1 is a side view of an automobile depicting a location of a fuel tank and a fuel pump module.
Figure 2:
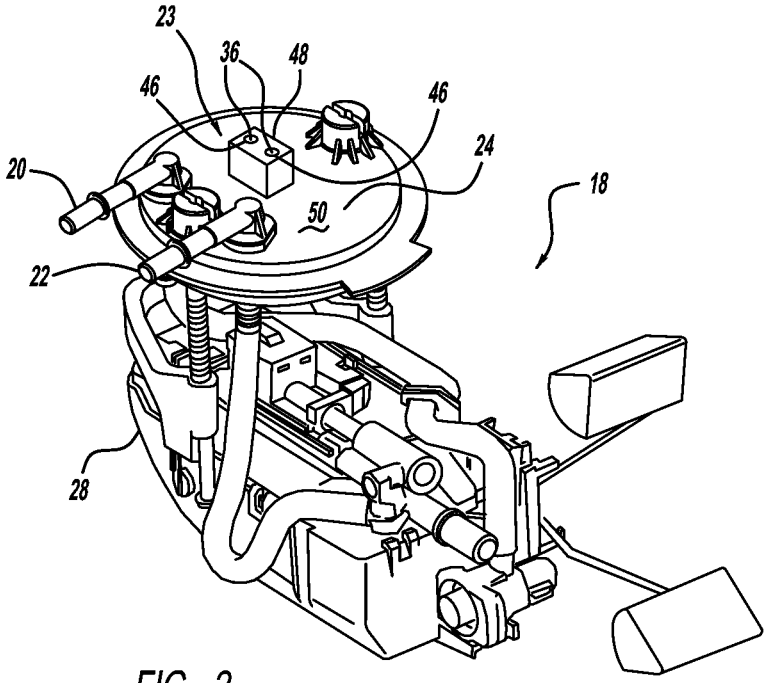
FIG. 2 is a perspective view of a fuel pump module depicting a fuel pump module flange.

Example embodiments will now be described more fully with reference to FIGS. 1-5 of the accompanying drawings. Turning first to FIG. 1, a vehicle 10 may employ an engine 12, a fuel tank 14, a fuel line 16, which delivers liquid fuel from fuel tank 14 using a fuel pump module 18 situated within fuel tank 14. FIG. 2 depicts fuel pump module 18, which may employ a fuel inlet 20, if the fuel system on a vehicle is a return fuel system, and a fuel outlet 22, which delivers fuel to engine 12. A bottom surface of fuel pump module flange member 24 may reside against a top surface 26 of fuel tank 14, while a bottom surface of fuel reservoir 28 may reside against an interior bottom surface of fuel tank 14.

Figure 5:
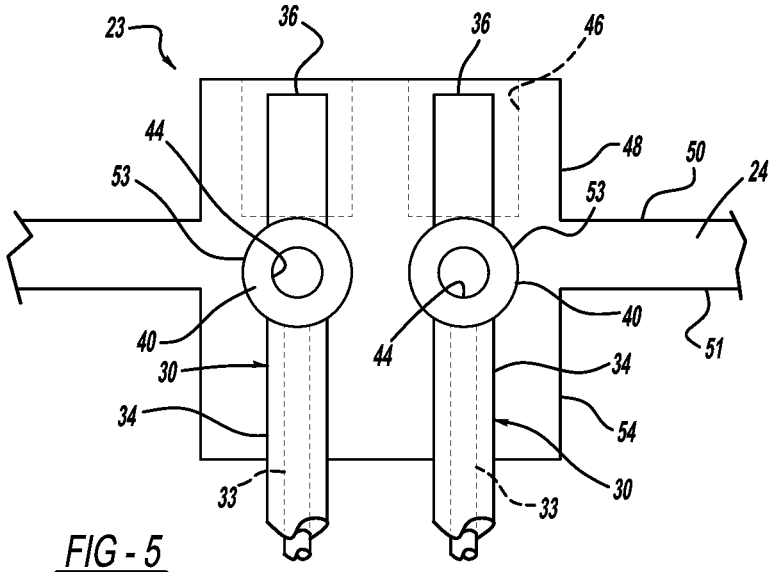
FIG. 5 is a side view of flattened, dual electrical terminals imbedded in a fuel pump module flange in accordance with the first embodiment.

As shown in FIGS. 2 and 5, the fuel pump module 18 can include a fuel pump module flange assembly 23. As will be discussed, the fuel pump module flange assembly 23 can be very robust. Also, the fuel pump module flange assembly 23 can provide electrical connection between the fuel pump module 18 and external components (e.g., a power source). Furthermore, the fuel pump module flange assembly 23 can seal electrical wiring therein. Additionally, the fuel pump module flange assembly 23 can be readily and efficiently manufacturable.

Figure 3:
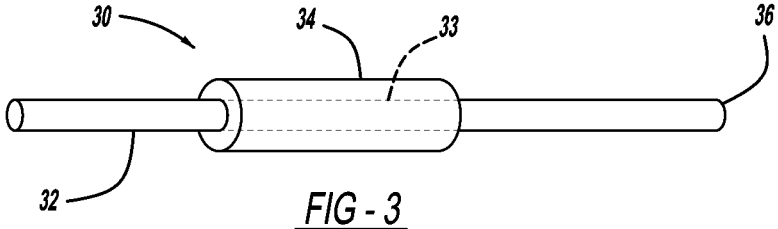
FIG. 3 is a side view of an electrical wire stripped in accordance with a first embodiment.

Turning now to FIG. 3, a wire assembly 30 is shown that can be included in the fuel pump module flange assembly 23 of FIGS. 2 and 5. The wire assembly 30 may have an electrically conductive wire 32 (i.e., a central conductor 32) and a surrounding insulator 34. The wire 32 may be made of a conductive metal such as combined strands of copper, or a single solid piece of copper. The insulator 34 can cover only a first portion 33 of the wire 32 and can leave a terminal end 36 of the wire 32 uncovered. For instance, the terminal end 36 of the wire 32 may be stripped of its insulator 34 such that the terminal end 36 remains exposed.

Figure 4:
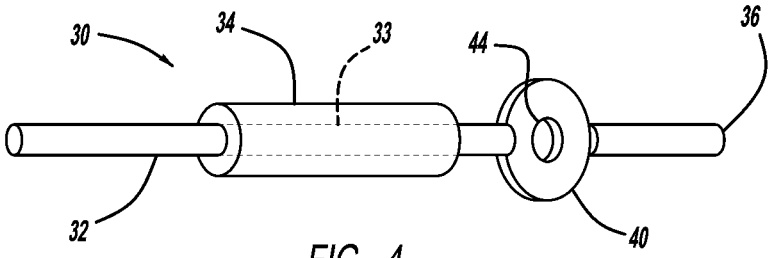
FIG. 4 is a top view of the electrical wire having a flattened alignment member and a terminal end in accordance with the first embodiment.

An alignment member 40 can be formed adjacent the end 36 as shown in FIG. 4. The alignment member 40 can have any suitable shape and can facilitate alignment of the wire assembly 30 relative to the flange member 24 (FIG. 2) as will be discussed in greater detail below. The alignment member 40 can be of any suitable shape. For instance, in the embodiments illustrated in FIG. 4, the alignment member 40 can be annular with an opening 44 (e.g., a through hole) extending therethrough. Also, the alignment member 40 can include substantially flat surfaces on both sides thereof as shown in FIG. 4. The alignment member 40 can be formed in any suitable fashion, such as via a stamping process. The alignment member 40 can be formed between the insulator 34 and the terminal end 36.

Referring back to FIG. 2 and now referring to FIG. 5, the flange member 24 will be discussed in greater detail. As shown, the flange member 24 can include an outer surface 50 and an inner surface 51 (FIG. 5). The inner surface 51 can face the interior of the fuel pump module 18, and the outer surface 50 can be opposite the inner surface 51. The outer surface 50 can be substantially flat except for an external boss 48 that protrudes from the outer surface 50, and the inner surface 51 can be substantially flat except for the internal boss 54 that protrudes from the inner surface 51. The external boss 48 can define one or more external cavities 46 as shown in FIGS. 2 and 5. When viewed from above, the external boss 48 can be square, rectangular, or circular. In FIG. 2, the external boss 48 is depicted as a rectangular structure with circular cavities 46. The internal boss 54 shown in FIG. 5 can be of any suitable shape.

The flange member 24 can be formed of a polymeric material or any other suitable material. Moreover, the flange member 24 can be a monolithic member. In some embodiments, the flange member 24 can be molded (e.g., injection molded). Moreover, the flange member 24 can be overmolded over the wire assembly 30 as will be discussed in greater detail below. As such, during manufacturing, the wire assembly 30 can be disposed within a mold (not shown), and the material of the flange member 24 can be introduced into the mold and molded around the wire assembly 30. The alignment member 40 can facilitate this process as will be discussed.

Once assembled, one or more wire assemblies 30 can extend through the flange member 24 as shown in FIGS. 2 and 5. (There are two wire assemblies 30 extending through the flange member 24 in the embodiment of FIGS. 2 and 5.)

The opening 44 of the alignment member 40 may be used for alignment of the terminal end 36 or the wire assembly 30 into tooling (e.g., a mold) during fabrication. Also, the opening 44 can be used for processing before being placed into flange member 24. Moreover, the opening 44 can be used for securing or holding wire assembly 30 within flange member 24 after overmolding. For instance, the plastic melt of the flange member 24 may pass into and be received within the opening 44 to form a secure mechanical lock of wire assembly 30 within the flange member 24, as depicted in FIG. 5.

Furthermore, the assembly can include an adhesive 53 as shown in FIG. 5. The adhesive 53 can coat the alignment member 40, the insulator 34, and/or any other suitable portion of the wire assembly 30. The adhesive 53 can be applied to the wire assembly 30 before being overmolded with the material of the flange member 24 such that the adhesive 53 is disposed between the alignment member 40 and the flange member 24. The adhesive 53 can facilitate bonding of the plastic used in overmolding the flange member 24 to the wire assembly 30.

FIG. 5 depicts a side-by-side or dual arrangement of identical wire assemblies 30 overmolded into flange member 24 to prevent movement of the wire assemblies 30 within the flange member 24. As depicted, the terminal ends 36 which may be electrical terminals, can be disposed and accessible within an external cavity 46 defined by the external boss 48. As such, the terminal ends 36 can remain exposed for engaging a separate, corresponding electrical connector, such as a female plug (not shown) for establishing electrical connection between the fuel pump module 18 and other electrical components (e.g., a vehicle battery, the ECU, or other component).

When overmolded in place as depicted in FIG. 5, the flange member 24 can surround, embed, and encase the alignment members 40 and a portion of the insulators 34 of the wire assemblies 30. The flange member 24 can also form a substantially hermetic seal (e.g., vapor-tight and liquid tight seal) with the alignment members 40. More specifically, the adhesive 53 can be applied to all surfaces of the alignment members 40 such that the adhesive 53 seals the alignment member 40 and the flange member 24. This seal can substantially prevent vaporous gas and liquid from passing between wire assembly 30 and flange member 24.

Because of the overmolding process used to form the flange member 24 over the wire assemblies 30, the assembly 23 can be manufactured in an efficient manner. Moreover, the wires 32 within the wire assemblies 30 can each be substantially monolithic between the respective terminal end 36 and first portion 33 (i.e., single, monolithic lengths of conductive material that extend between inner and outer surfaces of the flange member 24). Thus, because there are no separate electrical wiring connections to be made through the flange member 24, the electrical connections established by the wire assemblies 30 can be very robust, and the fuel pump module 18 is less likely to malfunction.

Figure 6:
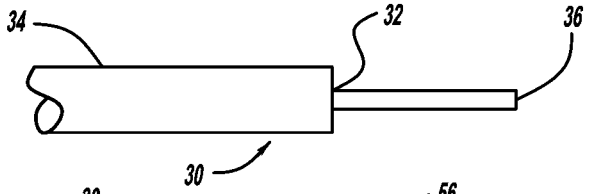
FIG. 6 is a side view of an electrical wire with a stripped end in accordance with a second and third embodiment.

Turning to FIGS. 6-11, additional embodiments of the teachings will be presented. FIG. 6 shows a wire assembly 30 substantially similar to the embodiments discussed above. More specifically, the wire assembly 30 includes the wire 32 (i.e., the central conductor) and the surrounding insulator 34, as in the prior explained embodiment.

Figure 7:
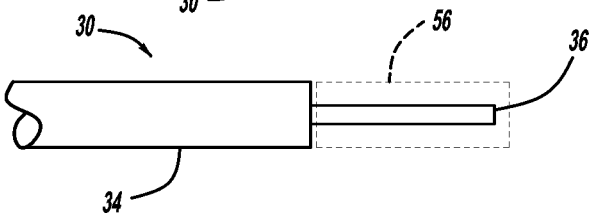
FIG. 7 is a side view of an electrical wire with a metal sleeve placed over the stripped end in accordance with a second embodiment.
Figure 8:
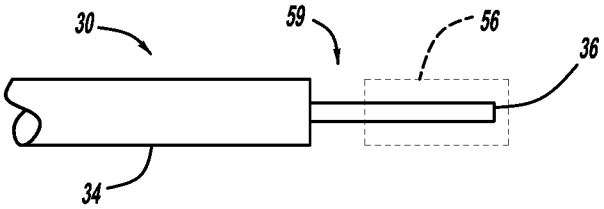
FIG. 8 is a side view of an electrical wire with a metal sleeve placed over part of the stripped end in accordance with a third embodiment.

As shown in FIGS. 7 and 8, the wire assembly 30 can also include an electrically conductive sleeve 56 (shown in phantom). FIG. 7 shows embodiments of the sleeve 56, and FIG. 8 shows other embodiments of the sleeve 56. In both embodiments, the sleeve 56 can be cylindrical and hollow. The sleeve 56 can be made out of electrically conductive material, such as metal. The sleeve 56 can cover the terminal end 36 of the wire 32. In the embodiments of FIG. 7, the sleeve 56 can be directly adjacent the insulator 34 (or can abut or cover the insulator 34), and in the embodiments of FIG. 8, the sleeve 56 can be spaced apart at a distance from the insulator 34 to define a gap 59 therebetween. Also, the opposite end of the sleeve 56 (i.e., the end directly adjacent the terminal end 36) can be open or closed. It will be appreciated, however, that the sleeve 56 can have any suitable shape.

Figure 9:
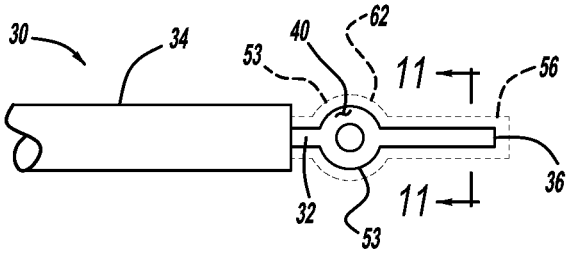
FIG. 9 is a top view of an electrical wire with a metal sleeve placed over part of the stripped end showing a location of an adhesive in accordance with the second embodiment.
Figure 10:
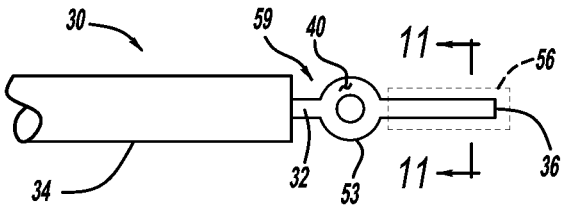
FIG. 10 is a top view of an electrical wire with a metal sleeve placed over part of the stripped end showing a location of an adhesive in accordance with the third embodiment.
Figure 11:
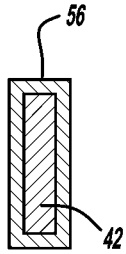
FIG. 11 is a section view taken along the line 11-11 of FIGS. 9 and 10.

During manufacturing, the insulator 34 can be stripped away to expose the terminal end 36 as shown in FIG. 6. Then, the sleeve 56 can be coupled to the wire 32 as shown in the embodiments of FIGS. 7 and 8. Next, as shown in FIGS. 9 and 10, the alignment member 40 described above in relation to the embodiments of FIGS. 1-5 can be formed in the wire 32. As discussed above, the alignment member 40 can be formed in a stamping process. In some embodiments, the wire 32 and sleeve 56 can be stamped simultaneously to flatten both. For instance, as shown in FIG. 11, the terminal end 36 of the wire 32 and the sleeve 56 can be stamped to have a polygonal cross section (e.g., a substantially rectangular cross section). Furthermore, in the embodiments of FIG. 9, an alignment member 62 can be formed in the sleeve 56 along with alignment member 40 in the wire 32, and the shape of the alignment members 40, 62 can closely correspond such that the sleeve 56 covers the alignment member 40 of the wire 32. In contrast, in the embodiments of FIG. 10, the alignment member 40 can be formed independent of the sleeve 56 within the gap 59 between the sleeve 56 and the insulator 34 (i.e., such that the sleeve 56 leaves the alignment member 40 uncovered). The remaining length of the wire 32 and the insulator 34 (i.e., the left side of the FIGS. 9 and 10) can remain circular in cross section.

In each of these embodiments, the sleeve 56 can cover the wire 32 to thereby reduce the likelihood of corrosion (i.e. improve corrosion resistance) of the terminal end 36. Also, the sleeve 56 can improve electrical contact with a corresponding receptacle, and electrical conductivity may be improved as corrosion resistance is improved.

As shown in FIG. 9, the adhesive 53 (discussed above) may also be applied to the external surfaces of the alignment member 62 and/or to the external surfaces of the alignment member 40. Likewise, as shown in FIG. 10, the adhesive 53 can be applied to the alignment member 40. As discussed above, the adhesive 53 can improve bonding between the plastic used to form the flange member 24 and the alignment members 40, 62.

Figure 12:
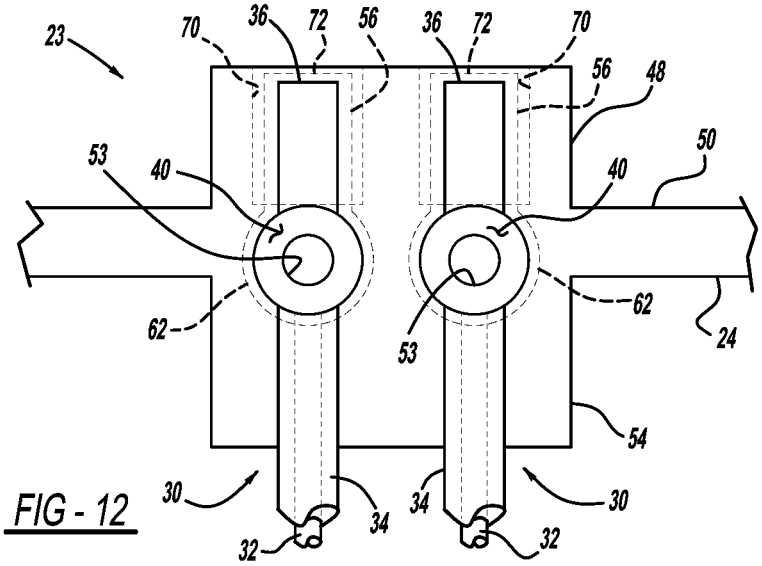
FIG. 12 is a side view of flattened, dual electrical terminals imbedded in a fuel pump module flange in accordance with the second embodiment.

FIG. 12 depicts a side-by-side or dual arrangement of the wire assembly 30 of FIG. 9 overmolded (i.e. embedded) into the flange member 24. As depicted, the terminal ends 36 surrounded by the sleeves 56 are each disposed and accessible within the cavity 70 defined by an outwardly protruding external boss 48 from a flange outer surface 50. That is, the sleeves 56, which act as conductive electrical plugs, are surrounded on all sides except for an end tip 72, which engages a corresponding electrical conductor, such as a female plug.

When viewed from above flange member 24, outwardly protruding external boss 48 may be square, rectangular, circular, or any other shape. During overmolding, the material of the flange member 24 can be received within the alignment members 40, 62 to thereby couple the flange member 24 and the wire assembly 30. Additionally, the adhesive 53 applied to all sides of the alignment members 40, 62 can ensure that a hermetic seal exists between the flange member 24 and the wire 32 and the sleeve 56 to prevent vaporous gas and liquid gas from escaping along the wire assembly 30 from the fuel tank 14 and fuel pump module 18. Because of the overmolding process used to join the flange member 24 and the wire assemblies 30, a single, integral, robust non-detachable piece can be formed. Also, this process can be a very efficient manufacturing process.

Figure 13:
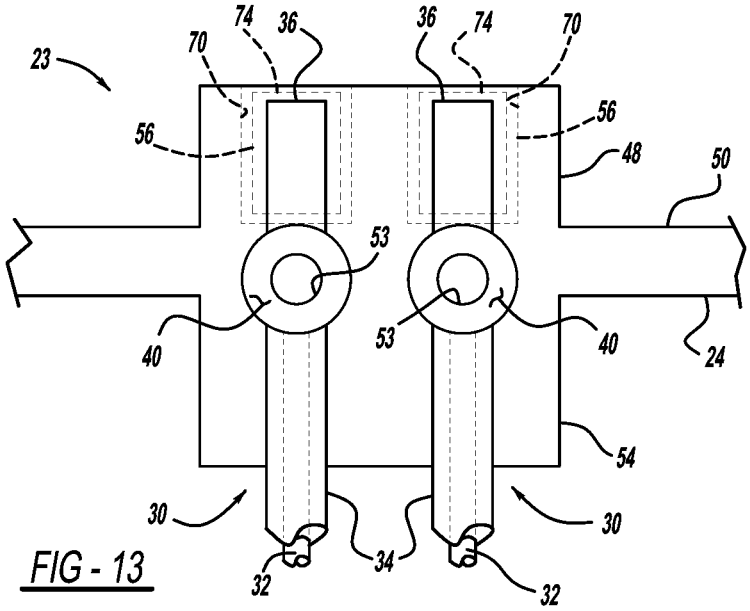
FIG. 13 is a side view of flattened, dual electrical terminals imbedded in a fuel pump module flange in accordance with the third embodiment.

FIG. 13 depicts a side-by-side or dual arrangement of the wire assembly 30 of FIG. 10 overmolded (i.e. embedded) into the flange member 24. As depicted, the terminal ends 36 surrounded by metal sleeve 56 are each disposed and accessible within the cavity 70 defined by an outwardly protruding external boss 48 from a flange outer surface 50. That is, the sleeves 58, which act as conductive electrical plugs, are surrounded on all sides except for an end tip 74, which engages a corresponding electrical conductor, such as a female plug.

When viewed from above flange member 24, as in FIG. 2, outwardly protruding external boss 48 may be square, rectangular, circular, or any other suitable shape. During overmolding, the material of the flange member 24 can be received within the alignment members 40. Additionally, the adhesive 53 applied to all surfaces of the alignment members 40 can ensure that a hermetic seal exists between the flange member 24 and the wire 32 to prevent vaporous gas and liquid gas from escaping from fuel tank 14 and fuel pump module 18 along the wire assembly 30. Because of the overmolding process used, a single, integral, robust, non-detachable piece is formed. Also, the manufacturing of the assembly 23 can be completed efficiently.

Figure 14:
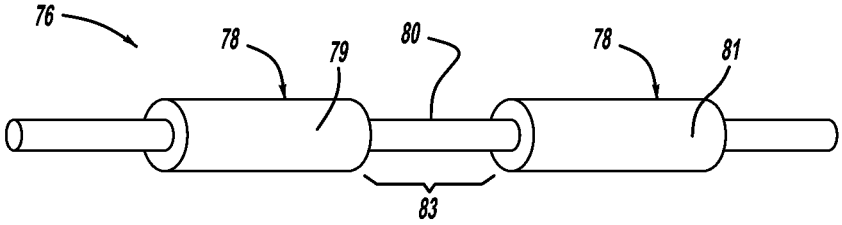
FIG. 14 is a perspective view of an electrical wire stripped in accordance with a fourth manufacturing process.

Turning to FIGS. 14-18, progressive manufacturing steps of a fuel pump module flange assembly 123 (FIG. 18) according to additional embodiments are depicted. More specifically, beginning with FIG. 14, a wire assembly 76 is stripped of its covering or insulation 78 to reveal a section of bare wire 80. The insulation 78 can be stripped to define a first insulator 79 and a second insulator 81, which are separated at a distance, and a bare, intermediate portion 83 of the wire 80 can be defined therebetween. The wire 80 as depicted in FIG. 14 may be circular in cross-section.

Figure 15:
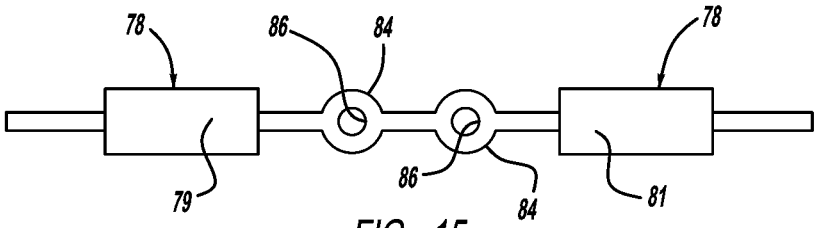
FIG. 15 is a top view of the electrical wire stamped in accordance with the fourth manufacturing process.
Figure 16:
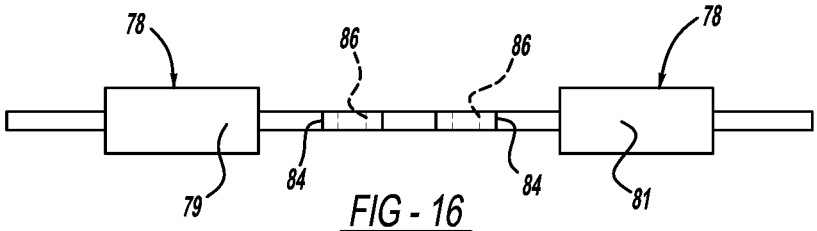
FIG. 16 is a side view of the electrical wire stamped in accordance with the fourth manufacturing process.

Then, as shown in FIGS. 15 and 16, the intermediate portion 83 can be stamped or otherwise flattened, and one or more alignment members 84 can be formed. Any number of alignment members 84 can be formed, and in the embodiments illustrated, there are two alignment members 84. Similar to the embodiments above, the alignment members 84 can be annular with a through hole 86. The alignment members 84 can be used as locator holes for tooling during a molding process and as a "lock" to secure the alignment members 84 to the flange member 24 (FIG. 18) during molding.

Figure 17:
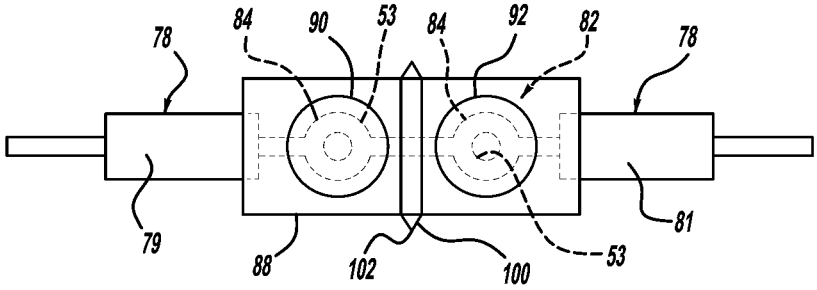
FIG. 17 is a side view of the electrical wire stamped in accordance with the fourth manufacturing process and employing a carrier.

FIG. 17 illustrates subsequent manufacturing steps, wherein a carrier 88 is added. The carrier 88 may be cylindrical in shape and have a circular cross-section. A boss 100 with or without a point 102 may be molded in carrier 88 as part of carrier 88. The carrier 88 can be made out of an electrically insulating material (e.g., plastic), and the carrier 88 can encase the alignment members 84 and a portion of the first and second insulators 79, 81. For instance, the carrier 88 can be overmolded around flat connector 82. The carrier 88 can be made of the same material as the flange member 24 (FIG. 18).

More specifically, the carrier 88 can completely surround the alignment members 84 and the portion of the insulators 79, 81 immediately adjacent thereto. To hasten adhesion and bonding to the carrier 88, and to create a seal therebetween, the adhesive 53 can be applied to the surfaces of the alignment members 84.

Figure 18:
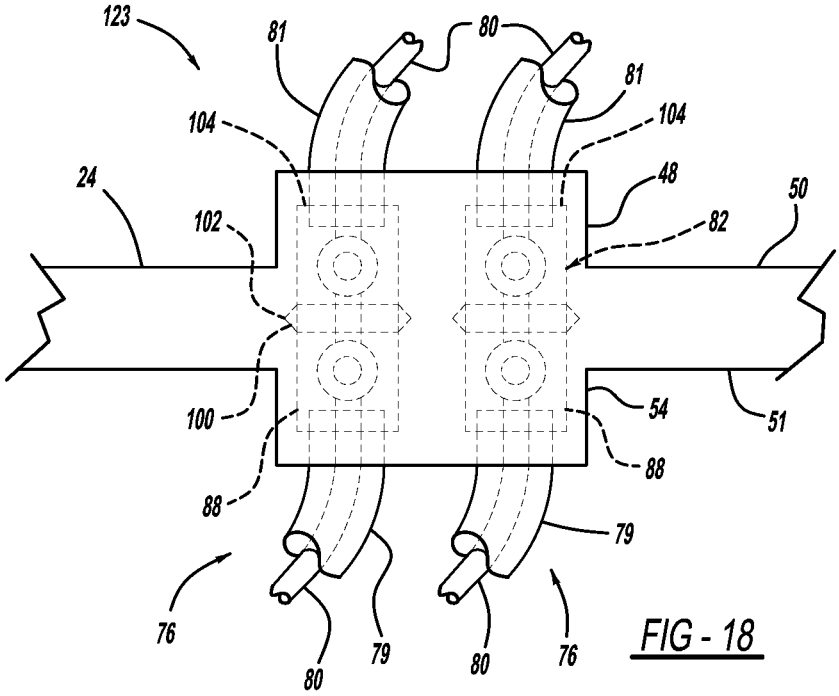
FIG. 18 is a side view of dual electrical wires overmolded with a fuel pump module flange in accordance with the fourth manufacturing process.

FIG. 18 depicts a side-by-side or dual arrangement of wire assemblies 76 within carriers 88 that are overmolded directly into fuel pump module flange member 24. More specifically, the alignment members 84, each covered by a respective carrier 88, may be arranged such that both are overmolded into flange member 24. As such, the wires 80 can protrude from exterior boss 48 and from an outer surface 50 of flange member 24, the wires 80 can protrude from internal boss 54 and from an inner surface 51 of flange member 24. Each individual wire 80 can be monolithic as it extends through the flange member 24 (i.e., each wire 80 can be monolithic as it extends between the inner and outer surfaces 50, 51 of the flange member 24).

The carrier boss 100 can protrude outwardly beyond a cylindrical diameter of the carrier 88. The carrier boss 100, with or without the point 102, can limit and reduce (e.g., eliminate) relative movement of the wire assembly 76, the carrier 88, and the flange member 24 in a direction parallel to the longitudinal axis of the wire assembly 76. That is, in addition to the adhesion of molding, ends of carrier boss 100 may be surrounded by plastic from the overmolding of carrier 88 into flange member 24. Thus, movement parallel to, or coaxial with, wire 96 or wire 98 can be prevented. Because wire assemblies 76 are molded (e.g., overmolded) within the plastic of the carriers 88 and the plastic of the flange member 24, and then carriers 88 are molded (e.g. overmolded) within the plastic of the flange member 24, liquid fuel and fuel vapor cannot escape from an inside of fuel pump module, or from an inside of fuel tank 14, to an outside of fuel tank 14.

Also, because the wires 80 remain monolithic through the flange member 24, the electrical connection provided thereby can be very robust. Also, the manufacture of the assembly 123 can be very efficient.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A fuel pump module flange assembly comprising:

a flange member with an outer surface, an inner surface, and an external boss protruding from the outer surface, the external boss defining an external cavity, the flange member being monolithic; and an electrically conductive wire that extends through the flange member, the wire having a first portion that protrudes away from the inner surface, the wire also including a terminal end that is disposed within the external cavity of the external boss, the wire being monolithic from the terminal end to the first portion and having an alignment member comprising a substantially flat surface with a through hole extending through the alignment member which receives a portion of the flange member to couple the flange member and the conductive wire.

2. The fuel pump module flange assembly of claim 1, further comprising an insulator that covers at least a portion of the first portion of the wire and that leaves the terminal end uncovered, the flange member at least partially covering the wire and at least partially covering a portion of the insulator.

3. The fuel pump module flange assembly of claim 1, further comprising an electrically conductive sleeve that covers the terminal end of the wire and the alignment member, the sleeve being disposed within the external cavity defined by the external boss.

4. The fuel pump module flange assembly of claim 1, further comprising an electrically conductive sleeve that covers the terminal end of the wire and that leaves the alignment member uncovered, the sleeve being disposed within the external cavity defined by the external boss.

5. The fuel pump module flange assembly of claim 1, further comprising an adhesive that is disposed between the alignment member and the flange member for attaching the flange member and the alignment member and for sealing the flange member and alignment member together.

6. The fuel pump module flange assembly of claim 1, wherein the flange member is overmolded around the electrically conductive wire.

7. The fuel pump module flange assembly of claim 1, wherein the terminal end has a cross section with at least one substantially flat side.

8. The fuel pump module flange assembly of claim 1, wherein the flange member further includes an internal boss protruding from the inner surface, the internal boss, the first portion of the wire protruding away from the internal boss.

9. The fuel pump module flange assembly of claim 1, wherein the alignment member has a different shape from a shape of the conductive wire.

10. The fuel pump module flange assembly of claim 1, wherein the alignment member has a different shape from a shape of the conductive wire and is disposed between two separate sections of the conductive wire.

11. A fuel pump module flange assembly comprising:

a flange member with an outer surface and an inner surface, the flange member being monolithic; and an electrically conductive wire that extends through the flange member from the outer surface to the inner surface, the wire including an intermediate portion disposed within the flange member between the outer surface and the inner surface, the intermediate portion including an alignment member that aligns the wire relative to the flange member, the wire being monolithic from outer surface to the inner surface of the flange member and having an alignment member comprising a substantially flat surface with a through hole extending through the alignment member which receives a portion of the flange member to couple the flange member and the conductive wire.

12. The fuel pump module flange assembly of claim 11, further comprising a first insulator and a second insulator that each cover the wire, the first and second insulators spaced apart with the intermediate portion defined therebetween, and further comprising an electrically insulating carrier that encases the intermediate portion and at least a portion of the first and second insulators, the carrier being disposed between the wire and the flange member.

13. The fuel pump module assembly of claim 12, wherein the carrier includes a carrier boss that projects outwardly from the carrier.

14. The fuel pump module assembly of claim 11, wherein the flange member includes an external boss protruding from the outer surface, the external boss defining an external cavity, the external boss being integrally connected to the outer surface so as to be monolithic, and wherein the wire includes a terminal end that is disposed within the external cavity of the external boss.

15. The fuel pump module flange assembly of claim 11, wherein the alignment member has a different shape from a shape of the conductive wire.

16. The fuel pump module flange assembly of claim 11, wherein the alignment member has a different shape from a shape of the conductive wire and is disposed between two separate sections of the conductive wire.

17. A fuel pump module flange assembly comprising:

a flange member with an outer surface, an inner surface, an external boss protruding from the outer surface, and an internal boss protruding from the inner surface, the external boss defining an external cavity, the flange member being monolithic; and an electrically conductive wire that is embedded within and extends through the flange member, the wire having a first portion that protrudes away from the inner surface, the wire also including a terminal end that is disposed within the external cavity of the external boss, the wire further including an annular alignment member that is disposed between the first portion and the terminal end, the annular alignment member including at least one flat surface and including a through hole that receives a portion of the flange member to couple the flange member and the wire, the wire being monolithic from the terminal end to the first portion, the flange member being overmolded around the electrically conductive wire.

18. The fuel pump module flange assembly of claim 17, wherein the alignment member has a different shape from a shape of the conductive wire.

19. The fuel pump module flange assembly of claim 17, wherein the alignment member has a different shape from a shape of the conductive wire and is disposed between two separate sections of the conductive wire.

* * * * *